United States Patent [19]

Jolicoeur

[11] 3,979,781

[45] Sept. 14, 1976

[54] NOZZLE ATTACHMENT FOR TOILET BOWL

[76] Inventor: Jean-Charles Jolicoeur, 740, rue Nicolle, Charlesbourg, Quebec 7, Quebec, Canada

[22] Filed: May 9, 1975

[21] Appl. No.: 576,085

[30] Foreign Application Priority Data

May 10, 1974 Canada ..... 199748

[52] U.S. Cl. ..... 4/1; 4/7

[51] Int. Cl.[2] ..... A47K 17/00

[58] Field of Search ..... 4/1, 7, 6; 134/6; 239/587

[56] References Cited

UNITED STATES PATENTS

| | | | |
|---|---|---|---|
| 1,835,497 | 12/1931 | Kahn | 4/7 |
| 2,466,144 | 4/1949 | Adams | 4/97 |
| 2,504,257 | 4/1950 | Dunn | 4/7 |
| 2,762,058 | 9/1956 | Hurko | 4/7 |
| 3,083,374 | 4/1963 | Watlington | 4/1 |
| 3,400,409 | 9/1968 | James | 4/1 |
| 3,462,766 | 8/1969 | Merkel, Jr. | 4/7 |
| 3,570,015 | 3/1971 | Rosengaus | 4/7 |
| 3,776,773 | 12/1973 | Taft | 4/1 |
| 3,894,562 | 7/1975 | Moseley, Jr. et al. | 138/44 |

*Primary Examiner*—Henry K. Artis

*Attorney, Agent, or Firm*—Raymond A. Robic; Arthur Schwartz

[57] ABSTRACT

The application discloses a nozzle attachment for a closet bowl formed at the top with a flushing rim defining a water passageway. The nozzle attachment is secured on the flushing rim and it has a water catching portion that extends in and across the passageway to capture water flowing in the passageway and a nozzle portion lying outside the passage and connected to the water catching portion to spray water received from it. In one particular embodiment, the nozzle discharges inside the bowl. In a further embodiment, the bowl flushing rim is provided with a basin that laterally and outwardly projects from the bowl and is connected, at the bottom, with the inside of the bowl. In this embodiment, the nozzle discharges into this basin.

5 Claims, 6 Drawing Figures

NOZZLE ATTACHMENT FOR TOILET BOWL

The present invention relates to a nozzle attachment for mounting on an existing water closet bowl.

An object of the present invention is to provide a bowl nozzle attachment capable of spraying cleaning water for wetting toilet paper before use so that by so doing a better and more sanitary cleaning action can be made while providing a substantial economy in toilet paper. To my knowledge, no existing water closet provides an easily accessible, practical and simple water supply for ablution purposes, as aforedescribed.

More specifically, a nozzle attachment made according to my invention is for use particularly with a closet bowl having a flusing rim defining a water passageway connected to a water supply. This attachment is for mounting on the flushing rim and has a water catching portion adapted to extend in and across the passageway to capture and deflect water flowing therein. The attachment also has a nozzle portion adapted to lie outside the passageway and connected to the water catching portion to spray water received therefrom. According to one particular embodiment of the invention, the nozzle portion is positioned to discharge inside the bowl. According to a further embodiment, the attachment is used on a bowl flushing rim provided with a basin that extends laterally and outwardly from the bowl and that is connected, at the bottom, with the inside of the bowl. The nozzle, in this embodiment, discharges into this basin.

The invention is also directed to the combination nozzle attachment and flushing bowl above described.

It is believed that a better understanding of the invention will be provided by the description that follows, having reference to the appended drawings wherein.

Figure 1:
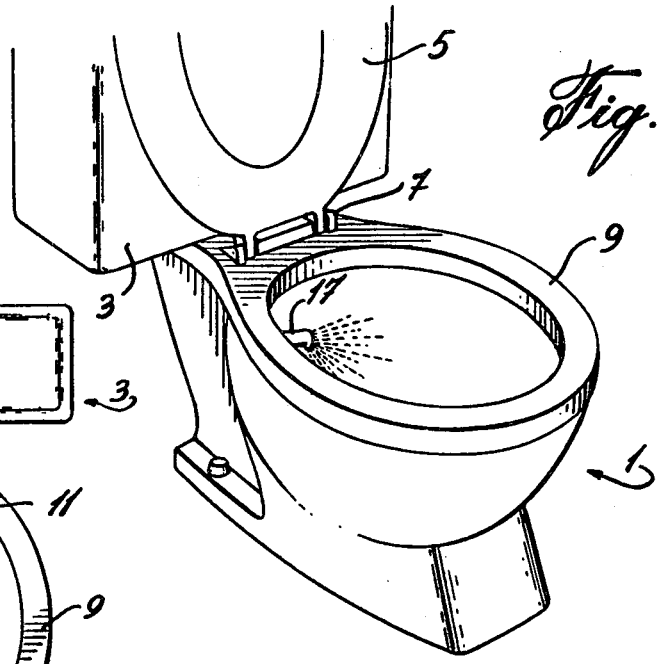
FIG. 1 is a perspective view of a water closet enclosing the nozzle attachment of my invention, according to one embodiment.
Figure 2:
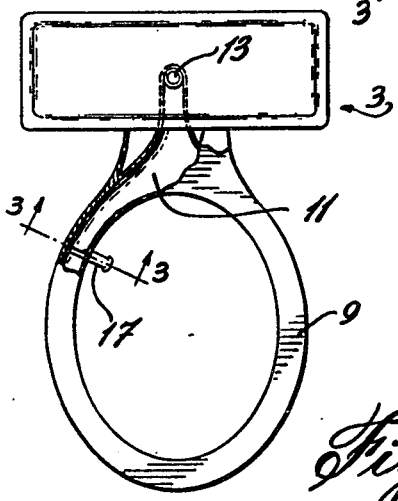
FIG. 2 is a top plan view of the closet of FIG. 1 with portion shown in cross-section to illustrate inner details.

Referring now to the drawings, particularly the embodiment of FIGS. 1 to 4, the nozzle attachment of my invention is shown mounted on a generally conventional water closet having a bowl 1 receiving fresh flushing water directly from a tank 3 and having a likewise conventional seat 5 hingedly connected to the top of the bowl 1 by means of any known hinge connection 7.

The bowl 1 is formed, at the top, with a flushing rim 9 defining a water passageway 11 directly connected to the tank 3 through its bottom, closed by a valved arrangement 13 of conventional type. As will be known, operation of this valve arrangement sends fresh water rushing and swirling into the passageway 11 to escape into the bowl 1 through a slot 15. As will easily be realized, the slot 15 may be a series of apertures located at the bottom of the passageway 11.

Figure 3:
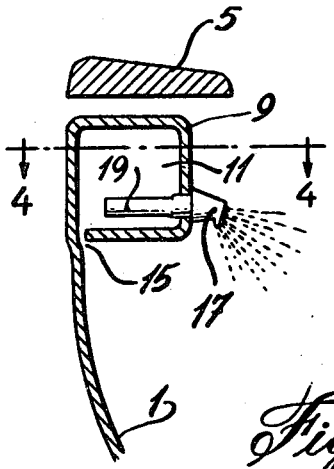
FIG. 3 is a side elevation view taken along line 3—3 of FIG. 2.
Figure 4:
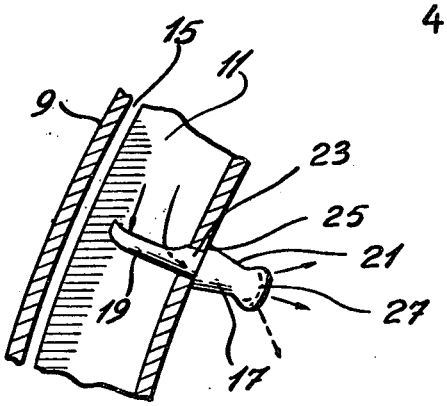
FIG. 4 is a cross-sectional view taken along line 4—4 of FIG. 3.

At one location along passageway 11, preferably on the right hand side of the bowl and closer to the back near the tank 3, the invention proposes the mounting of a nozzle attachment 17 connected on the inward vertical sidewall of the rim 9, as best illustrated in FIGS. 3 and 4. This attachment 17 is formed of a water catching portion 19 extending in and across the passageway 11 to capture water flowing therein and deflect it into a nozzle portion 21 outside the passageway 11 and into the bowl 1, this nozzle portion 21 being connected to the water catching portion 19 whereby to spray water received therefrom.

As best illustrated in FIG. 4, the water catching portion 19 may be a semi-cylindrical member closed at the end inside the passageway 11 and merging into a cylindrical connector 23 extending across an appropriate aperture in the inner wall of the rim 9. The cylindrical connector is integral with the nozzle portion 21 and a shoulder 25 is defined between the two which is adapted to sit against the inner surface of the rim 9. The nozzle has a spraying head 27 which preferably sprays a fine mist inside the bowl.

Figure 5:
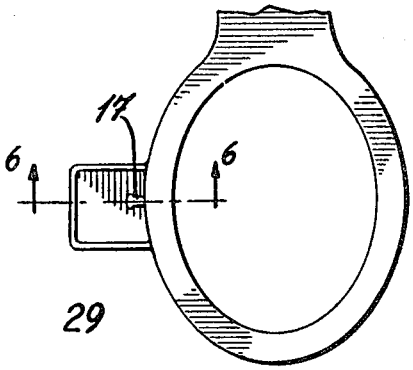
FIG. 5 is a top plan view of a second embodiment of the invention.
Figure 6:
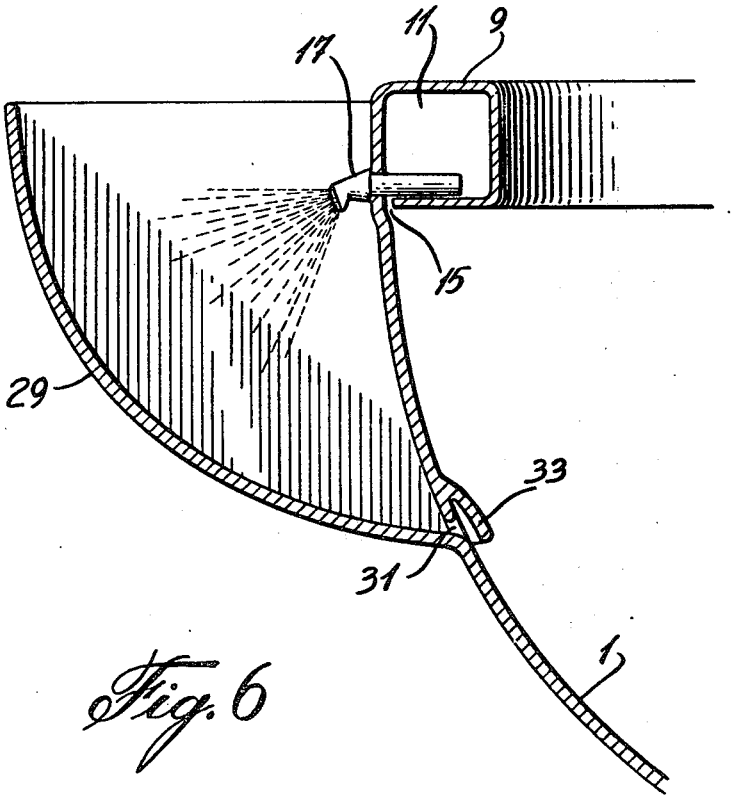
FIG. 6 is a cross-sectional view taken along line 6—6 of FIG. 5.

In the embodiment of FIGS. 5 and 6, the nozzle attachment 17 is identical to that of the first embodiment of FIGS. 1 to 4 except that the spraying head 27 discharges outwardly of the bowl 1 and into a basin 29 projecting outwardly laterally of the rim 1. This basin is in communication with the inside of the bowl by means of an aperture 31 at the bottom thereof and a water deflector 33 inside the bowl.

For greatest efficiency, the nozzle attachment 17 must of course be fluid tightly mounted on the rim 9, either on the inside wall thereof as in the embodiment of FIG. 3 or on the outside wall thereof as in the embodiment of FIG. 6.

It will be appreciated that many modifications of the above-described embodiments may be made while remaining within the ambit of the invention as defined in the appended claims.

I claim:

1. A nozzle attachment, for use in wetting toilet paper, in combination with a closet bowl formed at the top with a flushing rim defining a water passageway; said nozzle attachment mounted on said rim; said nozzle attachment comprising:

— a water catching portion extending in, at least partially across and substantially transverse to said passageway;

— a nozzle portion outside said passageway and

— bore means interconnecting said water catching portion and said nozzle;

— wherein said water catching portion is formed to capture water flowing into said passageway and deflect it into said bore means to allow it to flow through said nozzle portion.

2. A nozzle attachment as claimed in claim 1, including a water supply tank discharging into said passageway and wherein said nozzle attachment is mounted in the rear portion of said bowl adjacent said water tank.

3. A combination as claimed in claim 1 wherein said nozzle discharges inside said bowl.

4. A combination as claimed in claim 1 wherein said bowl flushing rim is provided with a basin positioned laterally and outwardly of said bowl and connected, at the bottom, with the inside of said bowl, and wherein said nozzle discharges into said basin.

5. A nozzle attachment as claimed in claim 1 wherein said water catching portion is a semi-cylindrical member and said nozzle portion is a hollow cylindrical member integral with and opening at one end into said water catching portion, the other end of said hollow cylindrical member being in the form of a water spraying head.

* * * * *